US012733786B2

(12) United States Patent
Santoemma

(10) Patent No.: US 12,733,786 B2
(45) Date of Patent: Sep. 15, 2026

(54) MACHINE FOR CLEANING AND SANITIZING

(71) Applicant: SANTOEMMA S.R.L., Pero (IT)

(72) Inventor: Massimiliano Santoemma, Bareggio (IT)

(73) Assignee: SANTOEMMA S.R.L., Pero (IT)

( * ) Notice: Subject to any disclaimer, the term of this patent is extended or adjusted under 35 U.S.C. 154(b) by 411 days.

(21) Appl. No.: 18/683,358

(22) PCT Filed: Aug. 31, 2022

(86) PCT No.: PCT/IB2022/058171

§ 371 (c)(1),
(2) Date: Feb. 13, 2024

(87) PCT Pub. No.: WO2023/031821

PCT Pub. Date: Mar. 9, 2023

(65) Prior Publication Data

US 2025/0134334 A1 May 1, 2025

(30) Foreign Application Priority Data

Sep. 1, 2021 (IT) ..... 102021000022688

(51) Int. Cl.
*A47L 11/40* (2006.01)
*A47L 11/32* (2006.01)

(52) U.S. Cl.
CPC ..... *A47L 11/4083* (2013.01); *A47L 11/325* (2013.01); *A47L 11/4088* (2013.01)

(58) Field of Classification Search
CPC . A47L 11/4083; A47L 11/325; A47L 11/4088
See application file for complete search history.

(56) References Cited

FOREIGN PATENT DOCUMENTS

| | | | |
|---|---|---|---|
| EP | 1915941 | A2 | 4/2008 |
| EP | 1915941 | A3 | 4/2008 |
| IT | MI20090487 | A1 | 9/2010 |

OTHER PUBLICATIONS

International Search Report issued Dec. 9, 2022 in PCT/IB2022/058171, 3 pages.
Written Opinion issued Dec. 9, 2022 in PCT/IB2022/058171, 5 pages.

*Primary Examiner* — Andrew A Horton
(74) *Attorney, Agent, or Firm* — Element IP, PLC

(57) ABSTRACT

A machine for cleaning and sanitizing contains an outlet, a flow selector, a hydraulic circuit, a pump, a first three-way hydraulic fitting, a detergent injector, a second three-way fitting, at least one air compressor, and a fourth three-way fitting. The hydraulic circuit contains a first branch, a second branch, and a third branch. The outlet of the machine is adapted to mount a foam or rinse water dispenser, which is adapted to emit foam from the first branch or water from the second branch. The air compressor is in flow communication with the third branch. The flow selector is adapted to divert either the foam from the first branch or the water from the second branch towards the outlet of the machine.

20 Claims, 5 Drawing Sheets

MACHINE FOR CLEANING AND SANITIZING

The present invention relates to a machine for cleaning and sanitizing.

In the state of the art, machines are known that can create a cleaning foam to be sprayed onto surfaces. Some of these are equipped inside with an air compressor, used to create compressed air to be mixed appropriately with a solution of water and chemical product. The use of compressed air, with a suitable pressure, is useful to create foam with an ideal density and compactness.

The foam generated by these machines has a density that depends on several factors, including the liquid solution used, consisting of water and chemical product appropriately mixed, the pressure and flow rate of compressed air, and the type of spray attachment used with the machine.

By spraying foam with a suitable density, it is possible to act advantageously on textile surfaces such as upholstered fabrics or carpets, or on hard surfaces such as walls, sanitary fittings, furnishings and other surfaces. The optimal density of the foam is that which allows it to act on the upholstered fabrics without penetrating too quickly in depth. Or, to act on vertical surfaces too, such as curtains, upholstery and textile walls, without quickly falling onto the floor.

Some machines are equipped with the option of rinsing the surfaces after foaming, with the advantage of completely removing residual foam and dirt from the surfaces themselves.

Finally, the same machines can be equipped with a suction system, which allows the liquid to be recovered from the treated surfaces or the floor, leaving them dry after the operation.

In order to achieve optimum foam density, to act on upholstered fabrics or hard surfaces, these machines use an air compressor to mix the liquid with the compressed air required to generate the foam.

Other components such as hydraulic pumps and appropriate mixing circuits are provided in these machines, with the purpose of pushing the liquid solution along the hydraulic circuit and mixing it appropriately with compressed air.

Some machines are equipped with suction motors and suitable circuits and accessories that allow the liquid to be sucked into a recovery tank.

These machines are suitable for "thorough" cleaning and sanitizing, with the frequency desired by the user and also decided according to the degree of dirt to be removed. In certain cases, even more frequent room sanitization would be necessary to keep rooms constantly sanitized.

There are specific machines for this purpose, capable of sanitizing rooms by spraying a sanitizing chemical product, so as to wet the already clean surfaces very little. The amount of liquid nebulized by these machines is the amount strictly necessary to sanitize an already clean environment and is therefore much less than if dirty surfaces also need to be cleaned.

Disadvantageously, two different machines would be needed, one to act on dirty surfaces and a different one to quickly sanitize already clean surfaces. The user has to buy and use two different machines, with disadvantages in terms of higher costs, more space and transport difficulties.

EP 1915941 A2 by the Applicant describes a machine for cleaning and sanitizing comprising a hydraulic circuit comprising a first branch, a second branch and a third branch, a pump introducing water into said hydraulic circuit at a predefined pressure, a first three-way hydraulic connection comprising an inlet connected in flow communication with said pump, a first outlet connected in flow communication with said first branch and a second connected outlet in flow communication with said second branch, a detergent injector introducing a detergent into the first branch of the circuit, wherein said detergent injector is mounted in flow communication with said first branch.

Also IT MI20090487 A1 by the Applicant describes a spray and suction machine similar to EP 1915941 A2.

The purpose of the present invention is to provide a single machine for cleaning and sanitizing that enables both the cleaning of surfaces of any kind by spraying a cleaning foam and, if necessary, rinsing them, and the rapid sanitizing of surfaces and rooms by fine nebulization of a sanitizing chemical product.

In accordance with the invention, such an object is achieved with a machine for cleaning and sanitizing according to claim 1.

Other features are provided in the dependent claims.

The features and advantages of the present invention will be more apparent from the following description, which is to be understood as exemplifying and not limiting, with reference to the appended schematic drawings, in which.

Figure 1:
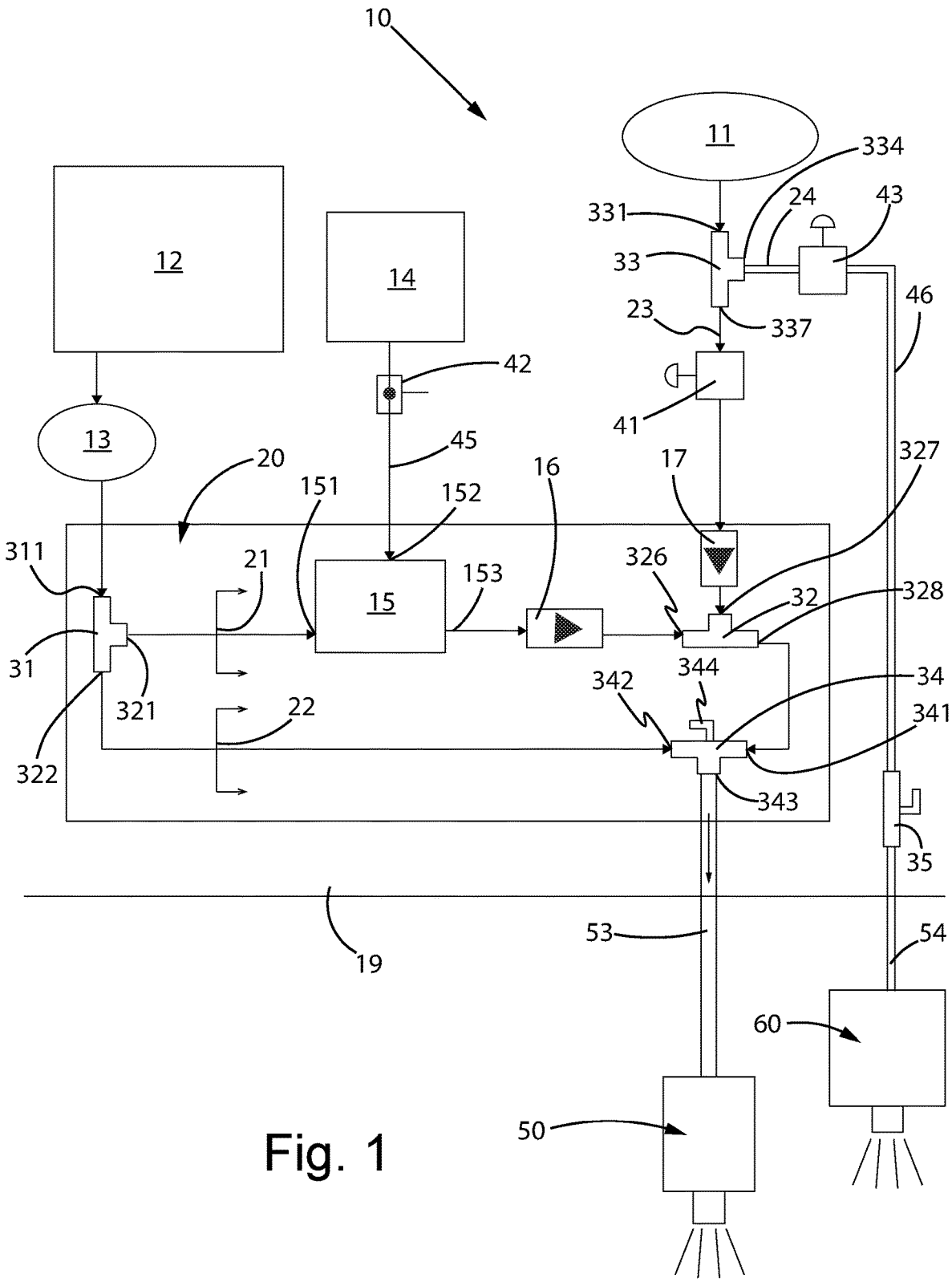
FIG. 1 is a schematic view of a machine for cleaning and sanitizing according to the present invention.

A machine for cleaning and sanitizing 10, hereafter referred to as machine 10, is shown with reference to the above figures.

The machine 10 according to the present invention advantageously enables the cleaning and sanitizing of environments of various types, such as surfaces of toilet facilities, hospitals, retirement homes, schools, offices, hotels, restaurants, workplaces, swimming pools, sports centres and many other environments in places open to the public.

The machine 10 advantageously enables both the cleaning of various types of surfaces by spraying a detergent foam, possibly rinsing and sucking a liquid residue from the surfaces, and the sanitizing of surfaces and rooms by dispensing a mixture of air and sanitizing chemical product, wherein said mixture consists of very fine liquid particles.

The surfaces to be cleaned can be either hard surfaces such as floors, walls, sanitary fittings, furnishings, or textile surfaces such as carpets, upholstered fabrics and textiles of various kinds.

The machine 10 sprays the mixture of air and chemical product which, when nebulized into very fine particles, can take the form of a dry sanitizing fog that comprises advantageous characteristics.

Sanitization by means of dry fog can be carried out by dispensing a sanitizing product into an enclosed space, in order to saturate it with a sanitizing fog that acts after a suitable contact time; or it is possible to direct the sanitizing jet directly onto the surfaces, in order to distribute a sanitizing product over them in the form of a very thin layer that covers the surfaces evenly and homogeneously.

The advantage of the machine for cleaning 10 is that it can carry out two cleaning and sanitizing operations using the same machine 10, with obvious advantages in terms of cost, practicality and smaller dimensions for a user.

In addition, the two operations can be carried out very simply if necessary, switching from one to the other immediately.

With regard to cleaning surfaces, this is carried out by the machine 10 by foaming the surfaces with detergent foam and then rinsing the surfaces with clean water only.

Rinsing the surfaces is advantageously useful as it enables the complete and rapid removal of residues of the chemical product of the mixture, which could remain on the surfaces after washing with the foam of the mixture.

Advantageously, the present machine 10 allows the user to perform both functions using a single machine 10, without having to purchase two specific machines for the two different treatments, thus saving money and space.

A preferred embodiment of the machine 10 also allows the liquid to be sucked from surfaces, e.g. the floor, after the rinsing step.

The machine 10 comprises a body 19, at least one air compressor 11 which is preferably arranged inside the body 19 of the machine 10.

Preferably the body 19 of the machine 10 is a load-bearing structure, comprises movement wheels and even more preferably handles and/or grips for movement.

The compressor 11 is used both for an operating step of the machine 10 for cleaning, in which the machine 10 sprays foam, and for an operating step of the machine 10 for sanitizing, in which the machine 10 dispenses a sanitizing mixture in nebulized form over surfaces or into rooms.

The machine 10 comprises a first tank 12 that contains the clean water, which is used in the cleaning step; a hydraulic circuit 20; a pump 13 that draws the clean water from the first tank 12 and pushes it at a predefined pressure along the hydraulic circuit 20. The pressure of the water introduced into the hydraulic circuit 20 can be regulated via the pump 13.

The machine 10 also comprises a second tank 14 that contains a detergent, which is the chemical product.

The second tank 14 is preferably a canister of concentrated liquid detergent. In this case preferably the second tank 14 includes a closing cap suitably modified with fittings and pipes to take the detergent from the bottom of the second tank 14 and make it available to the machine 10.

Preferably, the second tank 14, which is connected to the machine 10 by means of special pipes, is placed on board the machine 10, even more preferably on a stable support surface of the machine 10. This embodiment is preferable as it advantageously allows the second tank 14 to be quickly replaced when the detergent is used up, without the chemical product having to be transferred from a new canister of product to the second tank 14 of detergent of the machine 10. Said detergent tank 14 is mounted inside a body 19 of the machine 10, wherein said detergent tank 14 is separably mountable with said body 19 so that it can be easily replaced. With this system for replacing the second tank 14 it is advantageously achieved that the chemical product used is not contaminated by external agents, e.g. by mixing with other products.

The hydraulic circuit 20 comprises two separate branches, a first branch 21 and a second branch 22, a first T-shaped fitting 31 being used to make water available under pressure to the first branch 21 and the second branch 22.

The first branch 21 connected to the first fitting 31 is a branch into which pressurized water flows, which enters a component of the machine 10 called the detergent injector 15.

The first T-shaped fitting 31 is a three-way hydraulic fitting and comprises an inlet 311 in flow communication with said pump 13, a first outlet 321 connected in flow communication with said first branch 21 and a second outlet 322 connected in flow communication with said second branch 22.

Figure 2:
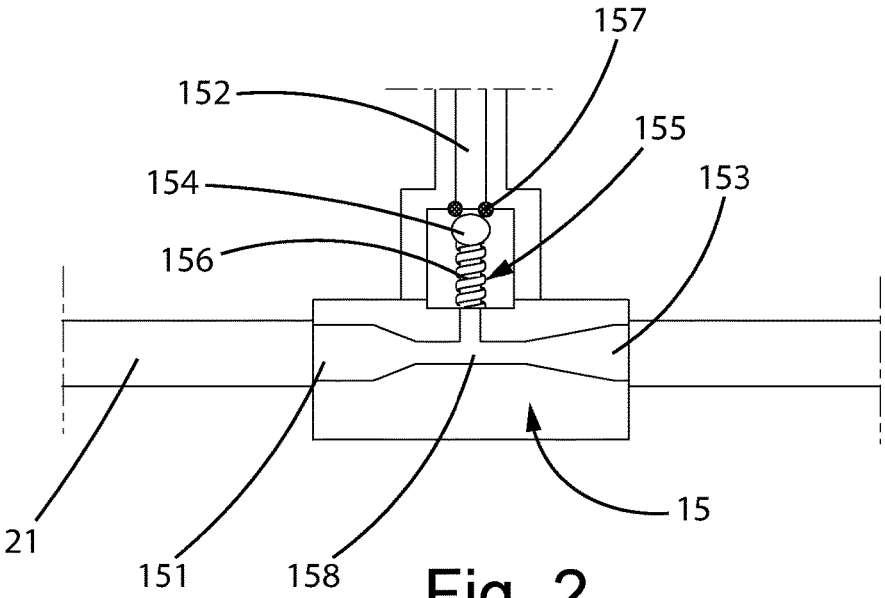
FIG. 2 is a schematic view of a detergent injector.

Preferably the detergent injector 15 is a Venturi effect injector, as shown in particular in FIGS. 1 and 2.

The detergent injector 15 comprises a first inlet 151, a second inlet 152, an outlet 153 and a chamber 158 that are in flow communication with each other.

The detergent injector 15 is mounted in flow communication with said first branch 21.

The first inlet 151 is connected in flow communication with the first outlet 321 of the first three-way hydraulic connection 31, the second inlet 152 is connected in flow communication with the detergent tank 14 containing the detergent.

The mixing chamber 158 is in flow communication with the first 151, the second inlet 152 and the outlet 153 of the detergent injector 15, wherein said mixing chamber 158 is adapted to mix the water with the detergent.

The chamber 158 comprises a smaller section than the section of the inlets 151 and outlet 153, so that the faster flow from the first inlet 151 to the outlet 153 creates a suction by Venturi effect of the detergent arriving from the second inlet 152. As shown in FIG. 2, the first inlet 151 and outlet 153 change size gradually until they reach the size of the chamber 158.

In addition, the section of the second inlet 152 is smaller than the sections of the first inlet 151 and outlet 153 in order to exploit the suction by Venturi effect.

The injector 15, receiving at its first inlet 151 water at a suitable pressure, a pressure which also depends on the pump 13, is able to create a vacuum in its second inlet 152. A pipe 45 is connected to the second inlet 152, which relates to the second detergent tank 14. Consequently, due to the Venturi effect of the vacuum generated in the second inlet 152, detergent is sucked from the second tank 14 towards the injector 15. The water entering from the first inlet 151 and the detergent entering from the second inlet 152 of the injector 15 are mixed inside the chamber 158 of the injector 15, thereby creating a liquid mixture of water and detergent which flows out of the outlet 153 of the injector 15.

Even more preferably, the optimal concentration of detergent within the mixture can be achieved by means of a component 42 of the circuit 20 that is inserted into the connecting pipe 45 between the injector 15 and the second tank 14. The component 42 is mounted upstream of the second inlet 152 of the detergent injector 15.

This component 42 creates a localised restriction in the tube 45 that prevents excessive suction of detergent from the second tank 14 and thus moderates the amount of detergent sucked in by the injector 15. In essence, the component 42 creates a restriction adapted to regulate a flow of detergent directed towards the second inlet 152 of the detergent injector 15.

By appropriately sizing the passage diameter of the narrowing of the component 42, the desired concentration is achieved. Preferably the concentration of detergent in the cleaning mixture is 3-5% by volume.

By changing the size of the narrowing of the component 42 at will, it is possible to use the machine 10 with a variety of detergent concentrations, which may also depend on the type of detergent used.

The flow of water through the injector 15 is ensured by sizing the pump 13 and sizing the circuit 20.

Preferably when the injector 15 is a Venturi effect injector, advantageously the depression at the second inlet 152 is only generated when the water flowing through it flows in the correct direction and with a predefined minimum flow rate.

Furthermore, in order to prevent the detergent from entering the circuit 20 even in the absence of a sufficient flow of water along the first branch 21 of the circuit 20, a device 155 is preferably added at the second inlet 152 of the injector 15 which prevents detergent from entering the mixing chamber 158 when there is not sufficient depression, for example when the pump 13 is switched off.

This device 155 is preferably a unidirectional device as shown in particular in FIG. 2, in which a ball 154 is pressed by a spring 156 against a gasket 157, so as to close off a passage section of the second inlet 152 and prevent detergent from entering the chamber 158 of the injector 15. The ball 154 is mounted with the spring 156 or a spring element and is adapted to pass from a closed position abutting against the gasket 157 to prevent the detergent from passing from the tank 14 into the chamber 158 to an open position to allow the detergent to pass into the chamber 158 of the detergent injector 15. When the depression generated by the injector 15 at the second inlet 152 is greater than a predefined minimum threshold value based on the elastic constant of the spring 156, the elastic force of the spring 156 is overcome by the depression and the ball 154 moves, allowing the passage of detergent from the second tank 14 to the chamber 158 of the injector 15.

At the outlet 153 of the injector 15 the solution enters a second unidirectional device 16 and then a first inlet 326 of a second mixing T-shaped fitting 32 of the circuit 20. The outlet 153 of the detergent injector 15 is mounted in flow communication with the unidirectional device 16 which in turn is mounted in flow communication with the first inlet 326 of the second three-way fitting 32.

The compressor 11 is used to generate the compressed air required for both creating the foam and for nebulization. The outlet of the compressor 11 enters a third T-shaped fitting 33 of circuit 20, which makes compressed air available to two other branches 23, 24 of the circuit 20: the third branch 23 and the fourth branch 24. A first pressure regulator 41 is arranged along the third branch 23 to stabilize the air pressure, so as to have a constant pressure during the foaming step of the machine 10.

The regulated compressed air enters a third unidirectional device 17 and then the second inlet 327 of the second mixing T-shaped fitting 32.

The machine 10 comprises the third unidirectional device 17 mounted in flow communication with the first outlet 337 of the third three-way fitting 33 and with the second inlet 327 of the second three-way fitting 32. The second mixing T-shaped fitting 32, which is a three-way fitting, includes an inner chamber (not shown in the figures) that pressure mixes the detergent solution and compressed air, and at the outlet 328 of the second mixing T-shaped fitting 32 a detergent foam with optimal density is produced. The density of the foam depends on the chemical product, i.e. the detergent, which must be suitable for the purpose, and depends on the pressures of the mixture and the compressed air, which are set to optimum values when the machine is manufactured.

The second three-way fitting 32 comprises the first inlet 326 mounted in flow communication with the outlet 153 of said detergent injector 15, the second inlet 327 mounted in flow communication with said third branch 23, the outlet 328 mounted downstream, the mixing chamber in flow communication with said first inlet 326, second inlet 327 and said outlet 328 of the second three-way fitting 32.

The pressurized foam enters a first inlet 341 of a hydraulic diverter 34. The hydraulic diverter 34 is a fourth three-way fitting comprising a diverter that is either a lever 344 or a tap or a technical equivalent.

The hydraulic diverter 34 is basically a three-way tap, which selectively connects an outlet 343 with either a first inlet 341 or a second inlet 342.

The hydraulic diverter 34 of the machine 10 provides that the first inlet 341 is connected to the outlet 328 of the second mixing T-shaped fitting 32 and that the second inlet 342 is connected to the second branch 22 of the circuit 20.

By turning a lever 344 of the hydraulic diverter 34 in order to select the first inlet 341, pressurized detergent foam is available at the outlet 343. This outlet 343 is placed in direct communication with the outlet 53 from the machine 10, to which a cleaning accessory is connected, by means of hoses of the appropriate length.

These hoses may possibly be detached from the machine 10 by means of special fittings inserted near the outlet 53 of the machine 10.

The second branch 22 connected to the first T-shaped fitting 31 is a hydraulic circuit connecting the pump 13 with the inlet 342 of the diverter 34. Only clean water flows in the second branch 22, so when the lever 344 of the diverter 34 is rotated to connect the outlet 343 with the second inlet 342, the machine 10 can only spray clean water, and thus carry out surface rinsing. The operation is to be carried out conveniently after the cleansing action of the foam.

By advantageously turning only the lever 344 of the diverter 34, the machine 10 switches instantly between foam spray and rinse operation.

Thanks to the switching described above, it is possible to use the same cleaning gun 50 of the machine 10 to carry out both foaming and rinsing, and the switching is very simple.

The cleaning gun 50 is more generally a dispenser of foam and rinsing water.

Note that the hydraulic diverter 34 is a three-way hydraulic T-piece like the first hydraulic T-shaped fitting 31, but unlike the first hydraulic T-shaped fitting 31, the hydraulic diverter 34 mounts a lever 344 or tap or technical equivalent to alternately divert either foam or water to the first outlet 53 of the machine 10 connected in flow communication with the cleaning gun 50 of the machine 10.

The fourth branch 24 connected to the third T-shaped fitting 33 comprises a pipe 46 that allows compressed air to reach a second outlet 54 of the machine 10.

This fourth branch 24 of the circuit 20 preferably includes a valve 35 capable of intercepting the passage of compressed air. When the valve 35 is open, compressed air can reach the second outlet 54 of the machine 10.

More generally, the valve 35 is mounted in flow communication with the fourth branch 24 and is adapted to switch from an open configuration to let compressed air passing to a closed position to block the compressed air in the fourth branch 24.

The second outlet 54 of the machine 10 is adapted to mount a second dispenser 60 adapted to nebulize a sanitizing product by means of compressed air arriving from the fourth branch 24.

Preferably, a second pressure regulator 43 for compressed air is also inserted along the connection between the third T-shaped fitting 33 and the second outlet 54 for the purpose of limiting the pressure value of the air at the outlet.

A dispenser of a mixture of air and sanitizing product 60 is connected to the second outlet 54 of the machine 10 by means of connecting pipes of suitable length. Such pipes may be detachable from the machine 10 by means of special couplings inserted near the second outlet 54.

The dispenser 50 of foam and water for rinsing is separably mounted in flow communication with the first outlet 53 of the machine and is preferably a manual spray gun comprising a lever that allows the dispensing to be operated or stopped by a user.

The foam and rinsing water dispenser 50 comprises a spray nozzle (not shown in the figures) of a section suitably sized to enable the foam or rinsing water to be dispensed by directing it towards the surfaces to be treated with a jet that is generally blade-shaped, with a fixed or variable spray angle.

The inlet of the gun 50 is separably connected to the first outlet 53 of the machine 10 by means of a connecting pipe that allows foam or liquid to pass through, depending on the selection made on machine 10 by means of the diverter 344, 364.

The second dispenser 60 is adapted to nebulize a sanitizing product by means of compressed air from the fourth branch 24.

Preferably the machine 10 comprises the dispenser 60 used for nebulizing the mixture of air and sanitizing product, which is separably mounted from the second outlet 54 of the machine.

The second dispenser 60 is connected by means of the second outlet 54 of the machine to the compressed air source 11 supplied by the machine 10 by means of a sufficiently long connecting pipe 61. This pipe 61 can also comprise a multiplicity of several pipes, can be a few centimetres in length in the case in which the second dispenser 60 is separably mounted with the body 19 of the machine 10, or several metres in length in the case of working at a distance from the body 19 of the machine 10.

Figure 6:
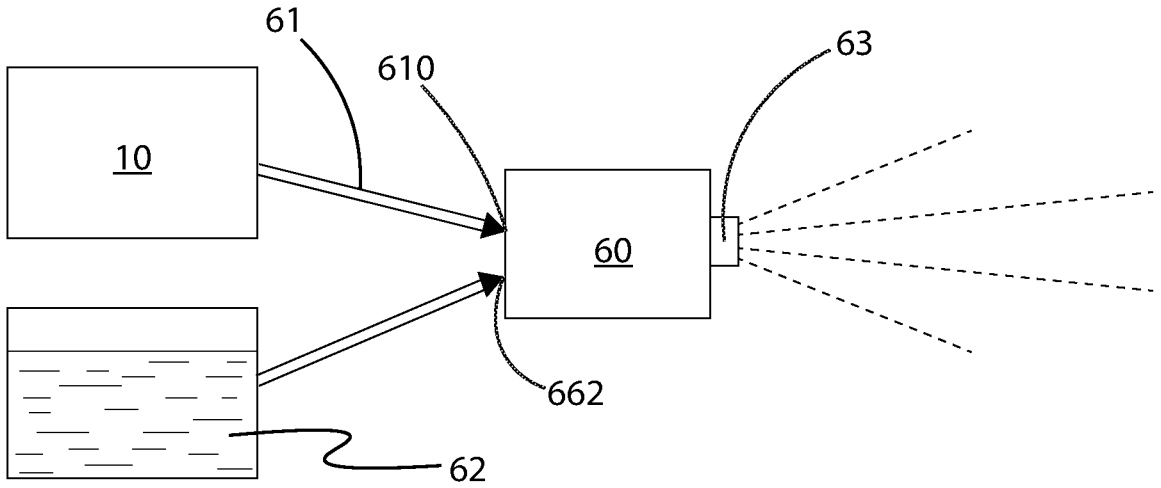
FIG. 6 shows a schematic view of an assembly according to a first alternative of a second dispenser for nebulizing a sanitizing product with the machine.

As shown in FIG. 6, the second dispenser 60 is connected in flow communication with a third tank 62 of sanitizing liquid to be nebulized and ready for use, which the second dispenser 60 nebulizes by mixing the sanitizing product with compressed air from the second outlet 54 of the machine 10. It should be noted that this sanitizer in liquid form is generally different from the liquid used for cleaning by foaming, so it is provided that the third tank 62 is advantageously separated from the second tank of detergent 14.

The second dispenser 60 includes a nebulization nozzle 63 from which a mixture of air and sanitizing chemical product exits, nebulized into fine particles, thanks to the effect of compressed air that is able to break up the particles into very small droplets.

The size of the individual liquid particles in the mixture of liquid and compressed air exiting the dispensing nozzle 63 of the dispenser 60 depends on the type of nebulization nozzle 63. There may be particles, for example, with a diameter of about 50-100 microns, a so-called fine nebulization, or about 5-7 microns, a so-called very fine nebulization. The smaller the particles, the better the sanitizing product will be nebulized.

Spraying with particles in the order of 50-100 microns allows horizontal or vertical surfaces to be treated by coating them with a thin layer of sanitizing chemical product, so that these surfaces are only slightly wet. After a few minutes, performing its sanitizing action, the liquid particles tend to evaporate and the rooms therefore remain dry.

Nebulization with particles in the order of 5-7 microns can be used when surfaces are to be coated with an even thinner layer. This particle size also allows closed rooms to be easily saturated by delivering an aeriform mixture into the room that takes on the appearance of a "dry fog". This is able to reach all the surfaces and fill all the spaces in the room. By dispensing a sufficient amount of product, a closed room can be completely filled. The dry sanitizing fog remains in suspension without falling on the floor and without wetting the surfaces. It is left to act for the time necessary for effective sanitization.

Figure 7:
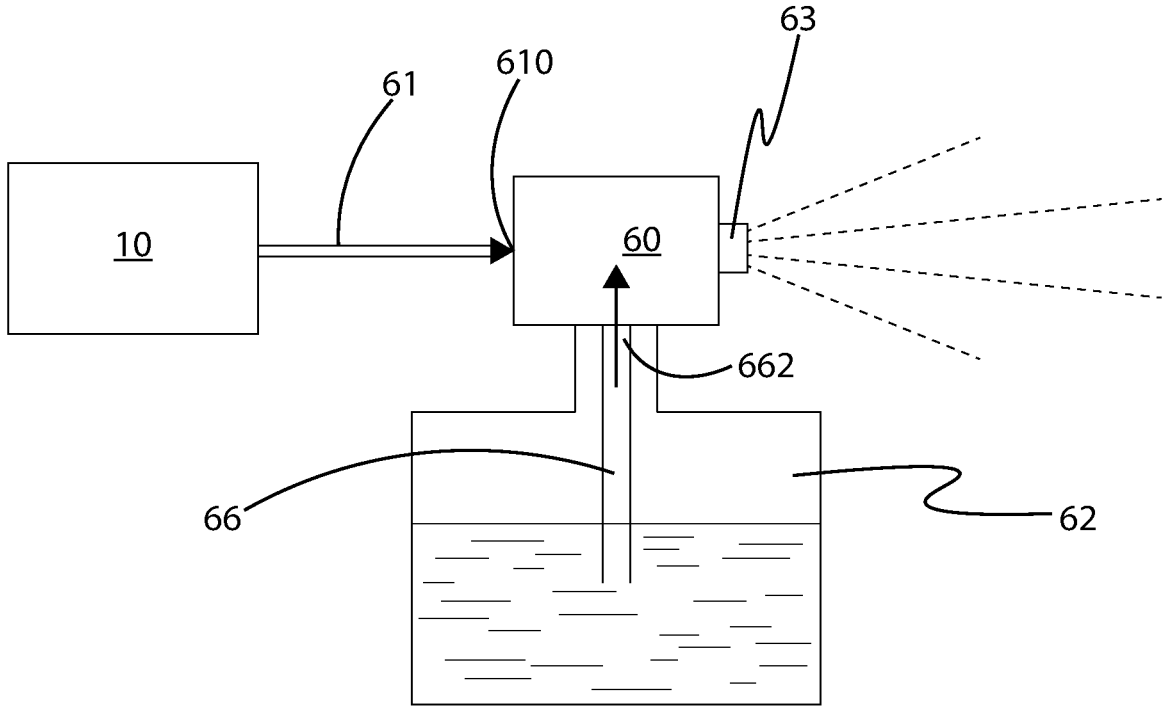
FIG. 7 shows a schematic view of an assembly according to a second alternative of the second dispenser for nebulizing the sanitizing product with the machine.

Alternatively, the third tank 62 of sanitizing product can be rigidly connected to the dispenser as shown in FIG. 7.

Figure 8:
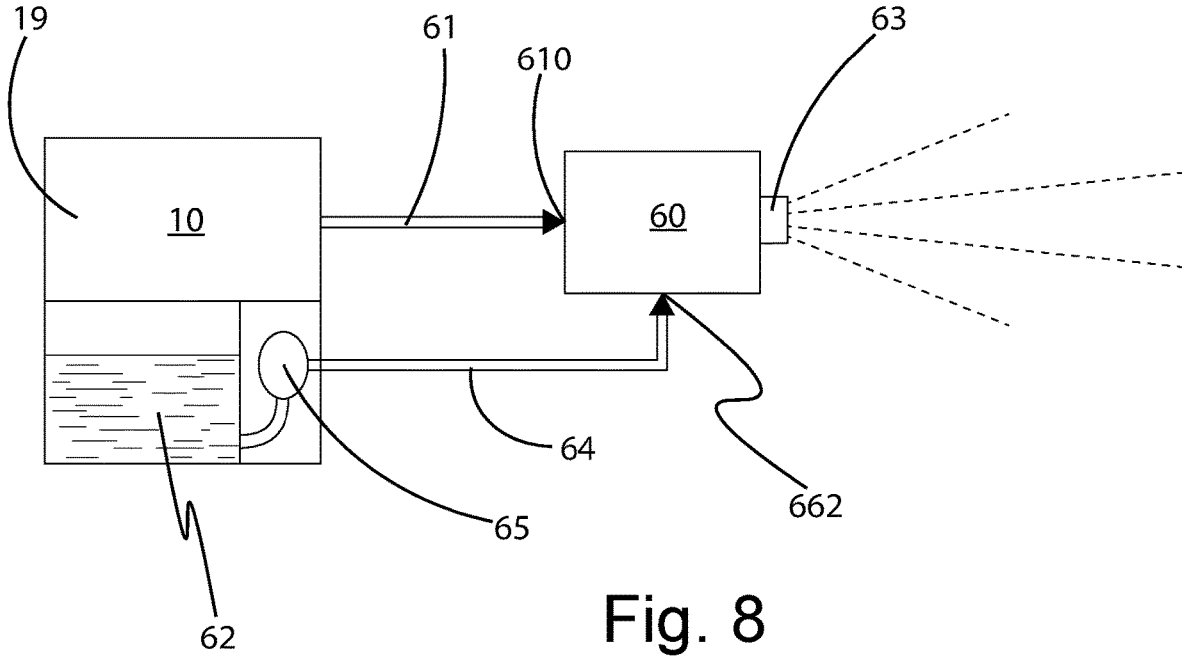
FIG. 8 shows a schematic view of a third alternative assembly of the second dispenser for nebulizing the sanitizing product with the machine in which a tank of the sanitizing product is mounted with a body of the machine.

Alternatively, the third tank 62 can be mounted with the body 19 of the machine 10 as shown in FIG. 8. In the event that the third tank 62 is housed on board the body 19 of the machine 10, then pipes 64 of appropriate length are used to connect the third tank 62 with the second dispenser 60. In the case of particularly long pipes 64, it is provided to equip the third tank 62 with an additional pump 65 to push the sanitizing liquid with sufficient pressure along the pipe 64, whereby said pump 65 is connected in flow communication with said second dispenser 60.

Alternatively, it is possible to provide for the same pump 12 to be used instead of the additional pump 65, for example by connecting the inlet of the pump 12 so that it sucks in the sanitizer.

Alternatively, the sanitizer can be loaded into the detergent tank 14 instead of the detergent, so that only the pump 12 can be used, instead of using the additional pump 65.

Preferably, the second dispenser 60 works by the Venturi effect, wherein the pipe 61 coming from the machine 10 brings compressed air to the air inlet 610 of the second dispenser 60. As compressed air passes through the dispenser, a depression is created by the Venturi effect at the liquid inlet 662.

As shown in FIG. 7, it is possible to provide that the second dispenser 60 is mounted directly on the cap of the third tank 62, wherein the liquid inlet 662 is directed towards the inside of the third tank 62 so that the depression allows liquid to be sucked in, by means of a small tube 66 placed inside the third tank 62. In this way, the sucked liquid product is mixed with the compressed air and the mixture exits from the nozzle 63 at high speed, being released into the surrounding environment in small droplets.

Alternatively, the liquid enters the second dispenser 60 not because of the Venturi effect, but because the sanitizing liquid is under pressure near the mixing point with the compressed air.

Alternatively, in the event that the third tank 62 is rigidly connected to the second dispenser 60, then it is possible to pressurize the third tank 62 using the same compressed air used for nebulization.

The second dispenser 60 may be in the form of a hand gun comprising a handle and a valve adapted to control or interrupt the spray. In this case, the user moves easily around the room to be sanitized, holding the gun and dispensing the nebulized sanitizing product directly onto the surfaces to be sanitized. The valve can intercept the passage of liquid, the passage of air or both. In this case, sufficiently long connecting pipes should connect the gun to the machine 10 so that the user can move easily in the spaces to be treated.

Alternatively, the second dispenser 60 can take the form of a device to be placed on a surface. This support surface can be the machine 10 itself, or a floor or table. The second dispenser 60 allows it to be placed inside a room and to act in the same room by dispensing sanitizing product nebulized into the air, even in the absence of the operator. The operation and interruption of dispensing are controlled by the user via the valve 35.

The valve 35 can be mounted near the second outlet 54 of machine 10, or near the second dispenser 60, or two valves 35 can be mounted, one near the second outlet 54 of the machine 10 and the other near the second dispenser 60.

The machine 10 can advantageously remain outside the treated room, while inside the room to be cleaned only the second dispenser 60 can be positioned, resting on a surface and connected to the machine 10 by means of suitably long pipes. The user, after placing the second dispenser 60 stably inside the room, can leave the room and remain outside during dispensing. For example, the form of the second dispenser 60 may be as shown in FIG. 7.

The machine 10 according to the present invention advantageously enables both functions of cleaning with foam and rinsing with the first dispenser 50 to be performed with a single apparatus by providing a simple switch that only requires turning a diverter 344, 364 and spraying a sanitizing chemical product very easily through the second dispenser 60.

Alternatively, the component 42 can be provided with an adjustable element to adjust the passage diameter of the pipe 45 so that the narrowing of the component 42 can be adjusted.

Figure 3:
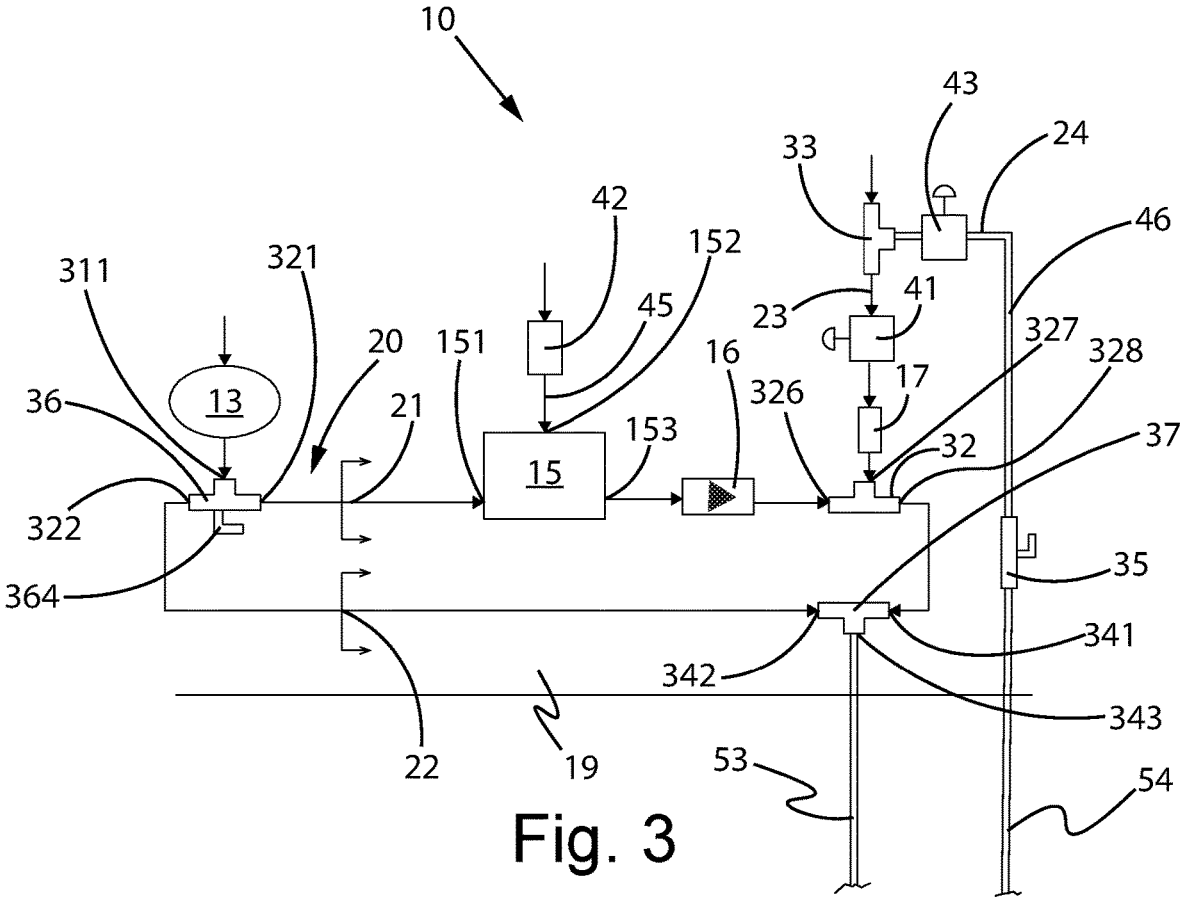
FIG. 3 is a schematic view of the machine according to a first alternative.
Figure 4:
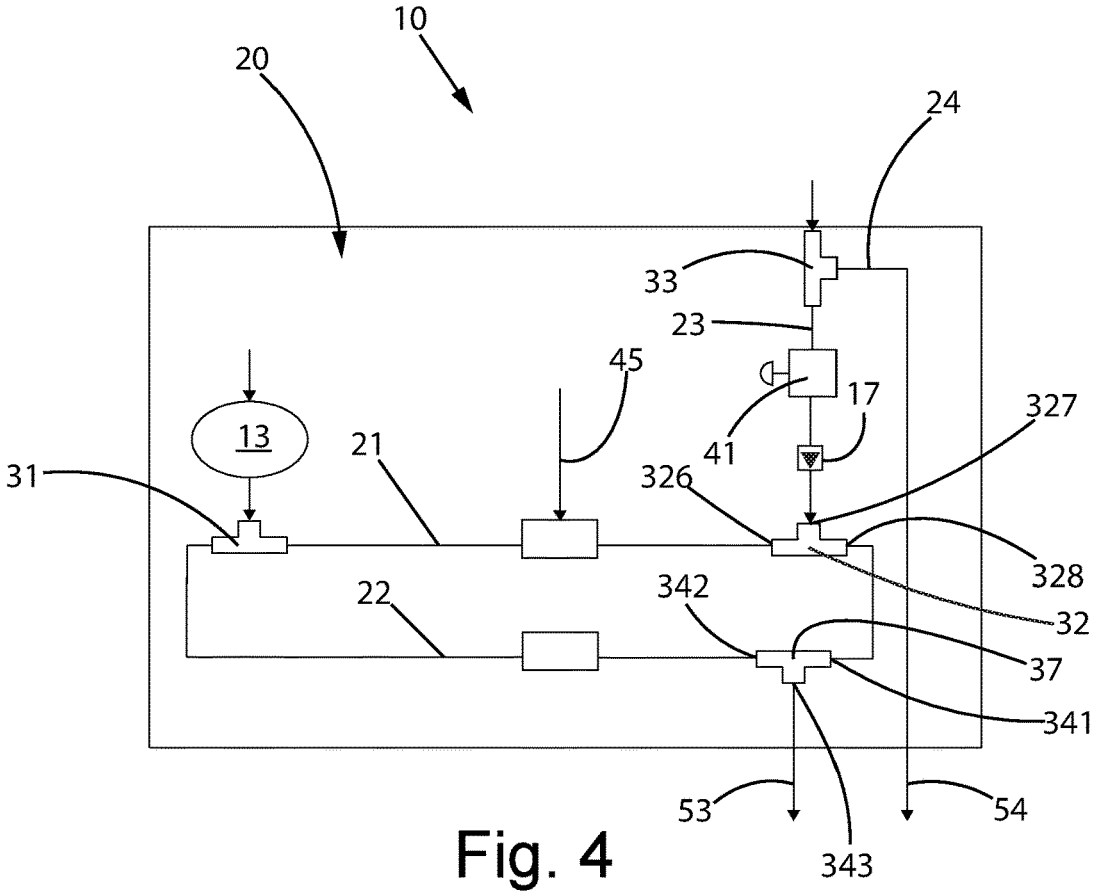
FIG. 4 is a schematic view of the machine according to a second alternative.

Alternatively, as shown in FIGS. 3 and 4, it is envisaged that the machine 10 does not comprise the first tank 12 containing the clean water, but that the machine 10 is connected to the water mains and that the pump 13 draws the clean water from the water mains and pushes it at a suitable pressure along the hydraulic circuit 20. According to this alternative, the pump 13 receives water directly from the water mains. The connection to the water mains in this case is made by means of pipes and release fittings that allow the machine to be connected to the mains before use and disconnected before storage. This alternative is advantageously versatile in environments where a connection to the water supply network is available, such as on campsites, toilets and showers in swimming pools, gyms and sports centres.

Alternatively, the second pressure regulator 54 is placed downstream of the second outlet 54 of the machine, e.g. mounted with the air and sanitizer mixture dispenser 60.

Alternatively, the machine 10 may also include other components such as a storage tank for compressed air (not shown in the figures). Even more advantageously, this further alternative envisages that the machine 10 also comprises a pressure switch (not shown in the figures) to regulate the pressure inside said compressed air storage tank. The compressed air storage tank advantageously supplies the machine 10 with a reserve of compressed air so that the compressor 11 does not have to be switched on and off every time compressed air has to be delivered.

Still alternatively as shown in FIG. 3 the mixing circuit 20 provides for mounting a hydraulic diverter 36 in place of the first T-shaped fitting 31 of FIG. 1 and mounting a fourth T-shaped fitting 37 in place of the hydraulic diverter 34 of FIG. 1. The hydraulic diverter 36 is a three-way hydraulic fitting comprising a lever 364 or a tap or diverter or technical equivalent to divert the flow of foam or water toward the first outlet 53 of the machine 10. The diverter 36 comprises the inlet 311 in flow communication with said pump 13, the first outlet 321 connected in flow communication with said first branch 21 and the second outlet 322 connected in flow communication with said second branch 22. This inversion maintains the operation of the circuit 20 of the machine unchanged, in fact, by turning the lever 364 on the diverter 36 it is possible to switch immediately between the foaming step and the rinsing step of the machine 10. In essence, the machine 10 may provide that the first three-way fitting 31, 36 comprises a diverter 364 adapted to divert the flow of foam or water towards the first outlet 53 of the machine 10, or that the fourth three-way fitting 34, 37 comprises a diverter 344 adapted to divert the flow of foam or water to the first outlet 53 of the machine 10.

More generally, the fourth three-way fitting 34, 37 comprises the first inlet 341 connected in flow communication with said outlet 328 of the second three-way fitting 32, the second inlet 342 connected with the second outlet 322 of the first three-way fitting 31, the outlet 343 connected to a first outlet 53 of the machine 10.

More generally, the diverter 344, 364 is mounted with at least one three-way fitting chosen from the first three-way fitting 31, 36 and the fourth three-way fitting 34, 37, wherein said diverter 344, 364 diverts either the foam coming from the first branch 21 or the water coming from the second branch 22 towards said first outlet 53 of the machine 10.

Alternatively, several air compressors 11 can be fitted in place of a single air compressor 11 to achieve the predefined pressure.

Alternatively, the second detergent tank 14 may not be part of the machine 10, but be mounted externally to the body 19 of the machine 10.

Alternatively, it may be provided that the cross-sectional dimensions of the chamber 158 of the injector 15 may be the same as or larger than the cross-sectional dimensions of the detergent inlet 152, as the chamber 158 has smaller cross-sectional dimensions than the inlet 151 and outlet 153 to allow for a convergent-divergent conduit.

Alternatively, the cross-section of the first inlet 151 and the second inlet 152 of the injector 15 may be the same.

Still alternatively, at least one pressure regulator 41, 43 is mounted with said third branch and mounted in flow communication between the second 32 and the third three-way fitting 33, and/or mounted with said fourth branch in flow communication between said third three-way fitting 33 and said second outlet 54.

Preferably the pressure regulator 41 is mounted with the third branch 23.

Alternatively, it is possible to provide that the machine 10 comprises other components that can be used in the different versions thereof, such as additional unidirectional and water filters, where said filters can be arranged at the inlet of the pump 13.

Alternatively, the unidirectional valve 16 can be mounted upstream of the detergent injector 15.

Figure 5:
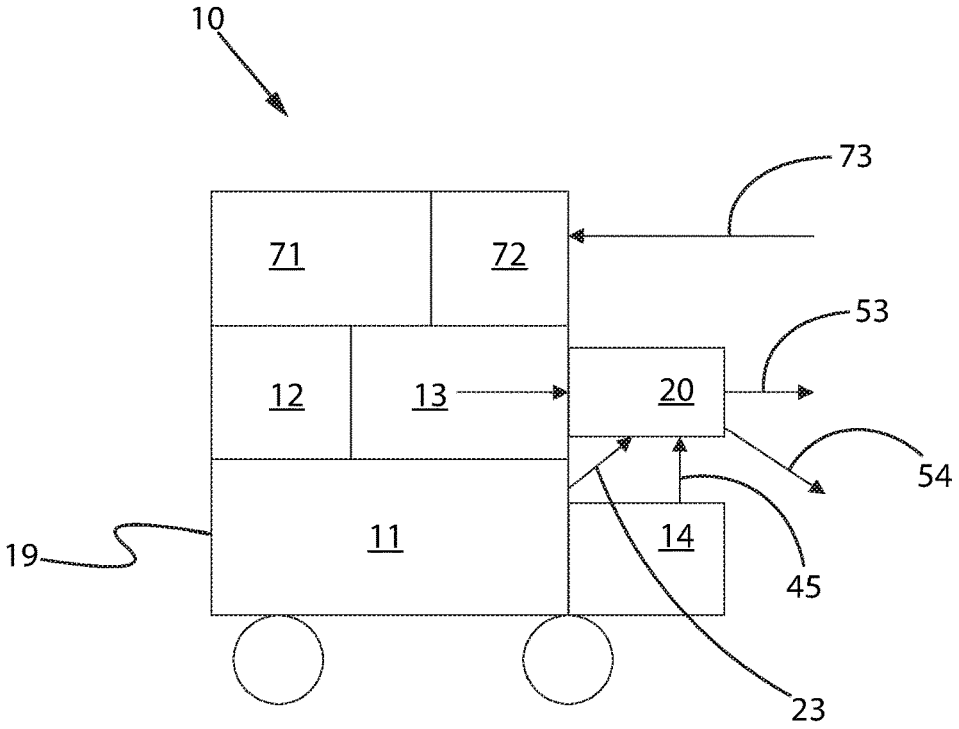
FIG. 5 is a schematic view of the machine including a liquid suction device.

Alternatively, and even more advantageously as shown in FIG. 5, the machine 10 comprises a liquid suction function. In this alternative, the machine 10 comprises a recovery tank 71 adapted to contain dirty liquids, a suction motor 72 adapted to suck said liquids towards said recovery tank 71, a suction tube 73 in flow communication with said suction motor 72 to recover the dirty liquid from washed and sanitized surfaces.

Alternatively, it is possible to provide that instead of said at least one diverter 344, 364 two taps (not shown in the figures) can be inserted that can close or open the branch 21, 22 on which they are mounted. For example, it would be possible to insert a first tap on the first branch 21 and/or to introduce a second tap on the second branch 22 in order to be able to select whether foam or nebulized product would come out of the first outlet 53 of the machine 10.

More generally, it can be provided that at least one flow selector is inserted, which may be said at least one diverter 344, 364 or can be at least one tap as specified above.

Alternatively, it is also possible to provide that the third three-way fitting 33 is not inserted into the machine 10 and that the fourth branch 24 is not inserted either. In this case it would be possible to nebulize by substituting the second dispenser 60 in place of the first dispenser 50, switching off the pump 13 while leaving the compressor 11 switched on so that only compressed air arrives at the outlet 53 after purging the residual liquid from the pipes of the circuit 20 and thus the second dispenser 60 can nebulize.

The invention thus conceived is susceptible to many modifications and variants, all falling within the same inventive concept. In practice, the materials used, as well as their dimensions, can be of any type according to the technical requirements.

The invention claimed is:

1. A machine for cleaning and sanitizing, the machine comprising:

a hydraulic circuit comprising a first branch, a second branch and a third branch, a pump introducing water into said hydraulic circuit at a predefined pressure, a first outlet adapted to mount a foam or rinse water dispenser, which is adapted to emit foam from said first branch or water from said second branch, at least one flow selector adapted to divert either the foam from the first branch or the water from the second branch towards said first outlet of the machine, a first three-way hydraulic fitting comprising an inlet in flow communication with said pump, a first outlet connected in flow communication with said first branch and a second outlet connected in flow communication with said second branch, a detergent injector introducing a detergent into the first branch of the hydraulic circuit, wherein said detergent injector is mounted in flow communication with said first branch, said detergent injector comprises a first inlet connected in flow communication with the first outlet of the first three-way hydraulic fitting, a second inlet in flow communication with a detergent tank containing the detergent, an outlet, and a mixing chamber in flow communication with the first inlet, the second inlet and the outlet of the detergent injector, and said mixing chamber is adapted to mix water with the detergent, a second three-way fitting comprising a first inlet mounted in flow communication with the outlet of said detergent injector, a second inlet mounted in flow communication with said third branch, an outlet, and a mixing chamber in flow communication with said first inlet, said second inlet and said outlet (328) of the second three-way fitting, at least one air compressor in flow communication with said third branch, and a fourth three-way fitting comprising a first inlet connected in flow communication with said outlet of the second three-way fitting, a second inlet connected with the second outlet of the first three-way hydraulic fitting, and an outlet connected to the first outlet of the machine.

2. The machine according to claim 1, wherein the hydraulic circuit further comprises a fourth branch, and the machine further comprises a third three-way fitting comprising a first inlet connected in flow communication with said at least one air compressor, a first outlet connected in flow communication with said third branch and said second inlet of the second three-way fitting, and a second outlet connected to said fourth branch, a second outlet adapted to mount a second dispenser adapted to nebulize a sanitizing product via compressed air from the fourth branch, and a valve mounted in flow communication with the fourth branch adapted to switch from an open configuration to let the compressed air pass to a closed position to block the compressed air in the fourth branch.

3. The machine according to claim 2, further comprising:

a third unidirectional element mounted in flow communication with the first outlet of the third three-way fitting and the second inlet of the second three-way fitting.

4. The machine according to claim 2, further comprising:

at least one pressure regulator mounted with said fourth branch.

5. The machine according to claim 1, wherein said at least one flow selector is at least one diverter mounted with at least one three-way fitting selected from the first three-way fitting and the fourth three-way fitting, and said at least one diverter diverts either the foam from the first branch or the water from the second branch towards said first outlet of the machine.

6. The machine according to claim 1, further comprising:

a first water tank connected to said pump, which draws water from said first tank.

7. The machine according to claim 1, wherein said detergent tank is inside a body of the machine, and said detergent tank is optionally separably mounted with said body.

8. The machine according to claim 1, wherein said detergent injector is a Venturi effect injector.

9. The machine according to claim 1, wherein a component is mounted upstream of the second inlet of the detergent injector creating a restriction adapted to regulate a direct detergent flow towards the second inlet of the detergent injector.

10. The machine according to claim 1, wherein the second inlet of the detergent injector mounts a device adapted to prevent the detergent from entering the mixing chamber when there is not sufficient depression.

11. The machine according to claim 10, wherein said device comprises a ball mounted with an elastic element adapted to pass from a closed position abutting against a gasket to an open position.

12. The machine according to claim 1, wherein the outlet of the detergent injector is mounted in flow communication with a unidirectional element which in turn is mounted in flow communication with the first inlet of the second three-way fitting.

13. The machine according to claim 1, wherein the first three-way fitting comprises a diverter adapted to divert the foam or water towards the first outlet of the machine.

14. The machine according to claim 1, wherein the fourth three-way fitting comprises a diverter adapted to divert the foam or water towards the first outlet of the machine.

15. The machine according to claim 1, further comprising:

at least one pressure regulator mounted in flow communication with the third branch.

16. The machine according to claim 1, further comprising:

an accumulation tank for compressed air.

17. The machine according to claim 1, further comprising:

a recovery tank adapted to contain dirty liquids, a suction motor adapted to suck said dirty liquids towards said recovery tank, and a suction tube in flow communication with said suction motor to recover the dirty liquid from washed and sanitized surfaces.

18. The machine according to claim 1, wherein said foam or rinse water dispenser contains a spray nozzle and is separably mounted in flow communication with said first outlet of the machine.

19. The machine according to claim 1, further comprising:

a second outlet, a second dispenser separably mounted with said second outlet, and a tank of sanitizing liquid to be nebulized, wherein said second dispenser is connected in flow communication with said tank.

20. The machine according to claim 19, wherein said tank is connected to the pump of the machine.

* * * * *